US012029952B2

(12) United States Patent
Jung

(10) Patent No.: US 12,029,952 B2
(45) Date of Patent: Jul. 9, 2024

(54) PITCHING TRAINING AID

(71) Applicant: Ko Hyung Jung, Namyangju-si (KR)

(72) Inventor: Ko Hyung Jung, Namyangju-si (KR)

( * ) Notice: Subject to any disclaimer, the term of this patent is extended or adjusted under 35 U.S.C. 154(b) by 185 days.

(21) Appl. No.: 17/605,563

(22) PCT Filed: Apr. 29, 2020

(86) PCT No.: PCT/KR2020/005670
§ 371 (c)(1),
(2) Date: Oct. 21, 2021

(87) PCT Pub. No.: WO2020/222526
PCT Pub. Date: Nov. 5, 2020

(65) Prior Publication Data

US 2022/0161113 A1 May 26, 2022

(30) Foreign Application Priority Data

May 2, 2019 (KR) ..... 10-2019-0051719
Feb. 25, 2020 (KR) ..... 10-2020-0023038

(51) Int. Cl.
*A63B 69/00* (2006.01)
*A63B 23/16* (2006.01)

(52) U.S. Cl.
CPC ..... *A63B 69/0002* (2013.01); *A63B 23/16* (2013.01); *A63B 2069/0006* (2013.01);
(Continued)

(58) Field of Classification Search
CPC ..... A63B 69/0002; A63B 2069/0006; A63B 2220/833
(Continued)

(56) References Cited

U.S. PATENT DOCUMENTS 4,679,799 A * 7/1987 Coletti ..... A63B 65/00 473/505
4,961,568 A * 10/1990 Clark ..... A63B 23/16 473/458
(Continued)

FOREIGN PATENT DOCUMENTS

CN 101605576 A 12/2009
CN 202028153 U 11/2011
(Continued)

OTHER PUBLICATIONS

English Specification of 10-2001-0032244.
(Continued)

*Primary Examiner* — Mitra Aryanpour
(74) *Attorney, Agent, or Firm* — ANTONIO HA & U.S. PATENT, LLC

(57) ABSTRACT

The present invention relates to a pitching training aid for shadow pitching training, the pitching training aid comprising: a receiving body which includes an inner receiving space and has openings at both sides thereof, and replicates a baseball in a state where a user encompasses and holds the receiving body with his/her hand or wears the receiving body on his/her fingers through the receiving space; a locking holder which is detachably inserted and fixed in the receiving space through the opening of the receiving body, and provides a locking region where locking through-holes are formed in the longitudinal direction, so as to allow at least one finger to be fitted and locked into the locking holder in the longitudinal direction, the locking holes extending in a curved shape having a predetermined curvature; and an elongated body which has a rod shape extending a predetermined length from one side of the receiving body, and provides load and vibration while being elastically deformed and restored by rotation of a user's arm.

16 Claims, 6 Drawing Sheets

(52) U.S. Cl.
CPC ..... *A63B 2209/10* (2013.01); *A63B 2220/44* (2013.01); *A63B 2220/833* (2013.01)

(58) Field of Classification Search
USPC ..... 473/458, 451
See application file for complete search history.

(56) References Cited

U.S. PATENT DOCUMENTS

| | | | | |
|---|---|---|---|---|
| 7,572,210 | B2 * | 8/2009 | Marinello | A63B 69/0059 482/44 |
| 2006/0135291 | A1 * | 6/2006 | Biegen | A63B 69/0002 473/451 |
| 2007/0135242 | A1 * | 6/2007 | Schoonover | A63B 69/0002 473/458 |
| 2011/0190082 | A1 * | 8/2011 | Nimura | A63B 69/00 473/458 |
| 2016/0206941 | A1 | 7/2016 | Voelkel et al. | |
| 2017/0252622 | A1 | 9/2017 | Ross | |
| 2022/0161113 | A1 * | 5/2022 | Jung | A63B 23/16 473/458 |

FOREIGN PATENT DOCUMENTS

| | | | | |
|---|---|---|---|---|
| JP | 2001-218881 | A | | 8/2001 |
| JP | 2001-523495 | A | | 11/2001 |
| JP | 2010-279672 | A | | 12/2010 |
| JP | 2010-279677 | A | | 12/2010 |
| JP | 3168586 | U | | 6/2011 |
| JP | 2012239537 | A | * | 12/2012 |
| KR | 10-2001-0032244 | | | 4/2001 |
| KR | 10-2009-0119821 | | | 11/2009 |
| KR | 20-2011-0009928 | | | 10/2011 |

OTHER PUBLICATIONS

English Specification of JP2010-279677A.
English Specification of JP2001-523495A.
English Specification of JP2010-279672A.
English Specification of JP2001-218881A.
English Specification of JP3168586U.
English Specification of CN101605576A.
English Specification of CN202028153U.
English Specification of 20-2011-0009928.

* cited by examiner

PITCHING TRAINING AID

TECHNICAL FIELD

The present invention relates to a pitching training aid, and more particularly, to a pitching training aid capable of facilitating shadow pitching training through arm swings in a state of being gripped in the user's hand or fitted over the user's finger.

BACKGROUND ART

In general, baseball players who enjoy baseball learn how to throw a ball if they first start playing baseball.

However, although investing the same amount of time, some throw well but others not.

This comes, firstly from differences in innate athletic ability and secondly from differences in physical condition, but finally and most importantly from differences in pitching technique that are learned while throwing the ball.

The pitching technique here refers to the upper body motion of holding and throwing the ball in the entire pitching motion.

Events that occur when a pitcher throws a ball may be specifically divided into FC, MER, BR, and MIR.

FC (Foot Contact) means the moment that the lifted foot lands on the mound, MER (Mzximal External Rotation) means the moment of maximum external rotation of the shoulder joint, BR (Ball Release) means the moment that the ball is released from the hand, and MIR (Maximal Internal Rotation) means the moment of maximum internal rotation of the shoulder joint.

Further, the above events may be divided into intervals of AC, AA, and AD according to the pitcher's arm motion.

AC (Arm Cocking) means the interval from the foot contact to the maximum external rotation of the arm, AA (Arm Acceleration) means the interval from the maximum external rotation to the release of the throwing arm, and AD (Arm Deceleration) means the interval from the release of the ball to the maximum internal rotation.

More specifically, in the AC (Arm Cocking) interval, the pitcher relaxes and drops his arm and then lifts the arm while making a circle, then maximally bends the arm over the head like a bow using the inertia of the arm and the ball and when reaching the maximum, releases the ball. This increases the arm acceleration period, which makes the ball faster and rotate more.

Resultantly, arm bending upon ball release is critical to increase the ball speed and rotations. Without arm bending, the distance for transferring force to the ball shortens, weakening the transferred force. Conversely, if arm bending can be made, the distance to transfer force to the ball becomes longer, so that the transferred force may also increase.

As the related art, Korean Patent Application Publication No. 10-2009-0119821 discloses a pitching practice device.

However, the prior art merely provides air resistance to the wrist but cannot induce arm bending.

Further, the prior art may be used only, with it fitted over the user's fingers, but not with it gripped in the user's hand, thus failing to simulate actual pitching.

In particular, since the prior art is unable to adjust the size of the finger holding portion, it may easily escape off the finger during pitching training.

Therefore, a need exists for a new technology capable of overcoming the foregoing problems of the prior art.

As a prior art document in the technical field to which the present invention pertains, there is Korean Patent Application Publication No. 10-2009-0119821.

DETAILED DESCRIPTION OF THE INVENTION

Technical Problems

The present invention has been conceived to address the foregoing problems of the prior art. The present invention aims to provide a pitching training aid capable of providing the feel of weight of a ball similar to that when an actual ball is thrown by aiding in arm bending through providing a load through a member, which is elastically deformed and restored by the rotation of arm to induce efficient shadow pitching.

The present invention also aims to provide a pitching training aid capable of aiding in shadow pitching training, with it gripped in the user's hand or fitted over the user's finger.

In particular, an object of the present invention is to provide a pitching training aid capable of adjusting the size of a hole of a stopping holder, fitted over the user's finger, while being configured to securely couple the stopping holder to the receiving body.

The present invention also aims to provide a pitching training aid in which as a stopping hole of a stopping holder fitted over the user's finger extends in a curved shape, the stopping holder may be seated on the finger.

The present invention also aims to provide a pitching training aid capable of adding weight and identifying and storing data, e.g., pitching posture, in the user's terminal.

Means to Address the Problems

To achieve the foregoing objectives, according to an embodiment of the present invention, a pitching training aid for shadow pitching training may comprise a receiving body having openings in two sides thereof, including a receiving space to simulate a baseball, a stopping holder removably inserted into the receiving space through the openings of the receiving body, having a stopping hole formed therethrough along a lengthwise direction thereof to provide a stopping portion, the stopping hole extending in a curved shape with a predetermined curvature, and an extension body extending from one end of the receiving body in a rod shape having a predetermined length.

Further, the stopping holder may include a holder body formed in a tubular shape having the stopping hole formed therethrough and fastened to the receiving space of the receiving body and an anti-escape member preventing the holder body from escaping off the receiving body.

Further, the holder body may include a dividing protrusion that protrudes along a lengthwise direction of the stopping hole and divides the stopping hole.

Further, the stopping hole may decrease in size from an entrance end to an exit end.

Further, the anti-escape member may include an anti-escape protrusion at each of two opposite ends, in a length direction, of the holder body and stuck to an end of the receiving space of the receiving body to prevent the holder body from moving in a lengthwise direction of the receiving space of the receiving body.

Further, the receiving body may have a plurality of gripping recesses formed in an outer circumferential surface thereof to provide a gripping portion.

Further, the extension body may include a post part formed on one end of the receiving body to provide support and an elastic shaft extending, in a rod shape, from the post part.

Further, the elastic shaft may thin as the elastic shaft extends, in a straight line, away from the post part.

Further, the extension body may further include a weight removably coupled to an end of the elastic shaft to provide weight.

Further, the weight may include a weight cap fitted and fastened to the end of the elastic shaft and having a built-in metallic weight body, and a cap fastening member fastening the weight cap to the end of the elastic shaft.

Further, the cap fastening member may include a hook-and-loop fastener fixed in a form of wrapping around the weight cap.

Further, the cap fastening member may further include a cap stopping groove circumferentially formed, in a groove shape, in an outer circumferential surface of the elastic shaft and a cap stopping jaw circumferentially protruding from an inner circumferential surface of the weight cap and stuck in the cap stopping groove.

Further, the pitching training aid may further comprise a holder pressurizing member installed in the receiving body to adjust a size of the stopping hole while pressurizing the stopping holder.

Further, the holder pressurizing member may include a pressurizing plate partially facing the stopping holder in a state movably coupled to the receiving body, and pressed by external force to move toward the stopping holder to reduce the size of the stopping hole, a bolt guide fastened to the receiving body while contacting the pressurizing plate to provide a screw coupling portion, and a pressurizing bolt screwed to the bolt guide and protruded toward the pressurizing plate by rotation to move the pressurizing plate.

Further, the pitching training aid may further comprise a sensor unit embedded in the receiving body or the extension body to detect at least one selected from the group consisting of an acceleration, angular velocity, and orientation of the rotation of a user's arm and a communication unit applying a detection signal obtained by the sensor unit to an application installed on the user's terminal.

Further, the application may calculate at least one selected from the group consisting of a pitching posture, ball speed, and ball rotation axis based on the detection signal applied from the sensor unit and output and store to the terminal.

Effects of the Invention

In the pitching training aid according to an embodiment of the present invention, when the arm rotates, the extension body is elastically deformed and restored in the opposite direction to the action of the rotation of the arm to thereby provide a load, thus providing such a feel as if an actual ball is thrown. Further, since the extension body may induce the maximum arm bending through reaction with the arm, effective shadow pitching is possible.

Further, the present invention enables pitching training, with the receiving body gripped in the user's hand or with the finger fitted into the stopping holder prepared in the receiving body, thus allowing for various types of shadow pitching training.

In particular, according to the present invention, the stopping holder fitted over the user's finger may be firmly fixed to the receiving body by the anti-escape member, and the size of the stopping hole of the stopping holder may be adjusted through the holder pressurizing member. Thus, the stopping holder may be prevented from arbitrarily escaping off during training.

Further, according to the present invention, the stopping hole of the stopping holder fitted over the user's finger may extend in a curved shape and seated on the finger, and may thus be more securely fitted.

Further, according to the present invention, the weight is removably coupled to an end of the elastic shaft constituting the extension body, thereby adding weight. Thus, it is possible to increase resistance to the arm rotation by the weight added as necessary, inducing larger rotation of the arm or body during shadow pitching.

Further, according to the present invention, since the acceleration, angular velocity, or orientation of the extension body may be detected by the sensor unit and applied to the application of the user's terminal, it is possible to visually identify, e.g., the pitching posture and results of practice, based on the applied data.

Effects of the disclosure are not limited to the foregoing, and other unmentioned effects would be apparent to one of ordinary skill in the art from the following description.

MODE TO PRACTICE THE INVENTION

Figure 1:
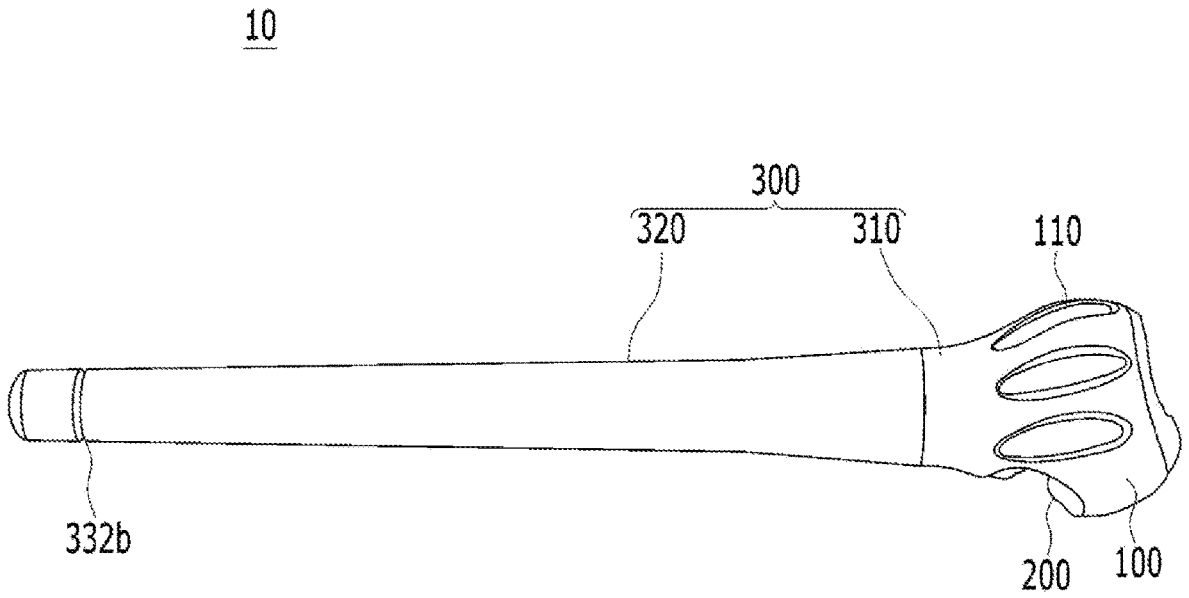
FIG. 1 is a front view illustrating a pitching training aid according to an embodiment of the present invention.

Hereinafter, embodiments of the present invention are described in more detail with reference to the accompanying drawings. In describing the present invention, detailed descriptions of related known general-purpose functions or configurations will be omitted.

Since various changes or modifications may be made to embodiments according to the concept of the present invention, specific embodiments are be illustrated in the drawings and described herein. However, it should be appreciated that the present invention is not limited to the embodiments, and all changes and/or equivalents or replacements thereto also belong to the scope of the present invention.

It will be understood that when an element or layer is referred to as being "on," "connected to," "coupled to," or "adjacent to" another element or layer, it can be directly on, connected, coupled, or adjacent to the other element or layer, or intervening elements or layers may be present. In contrast, when a component is "directly connected to" or "directly coupled to" another component, no other intervening components may intervene therebetween. Other terms or phrases representing the relationship between two or more components, such as 'between' and 'adjacent to,' may be interpreted the same way.

The terms as used herein are provided merely to describe some embodiments thereof, but not to limit the present invention. As used herein, the singular forms "a," "an," and "the" are intended to include the plural forms as well, unless the context clearly indicates otherwise. It will be further understood that the terms "comprise" and/or "have," when used in this specification, specify the presence of stated features, integers, steps, operations, elements, and/or components, but do not preclude the presence or addition of one or more other features, integers, steps, operations, elements, components, and/or groups thereof.

Figure 2:
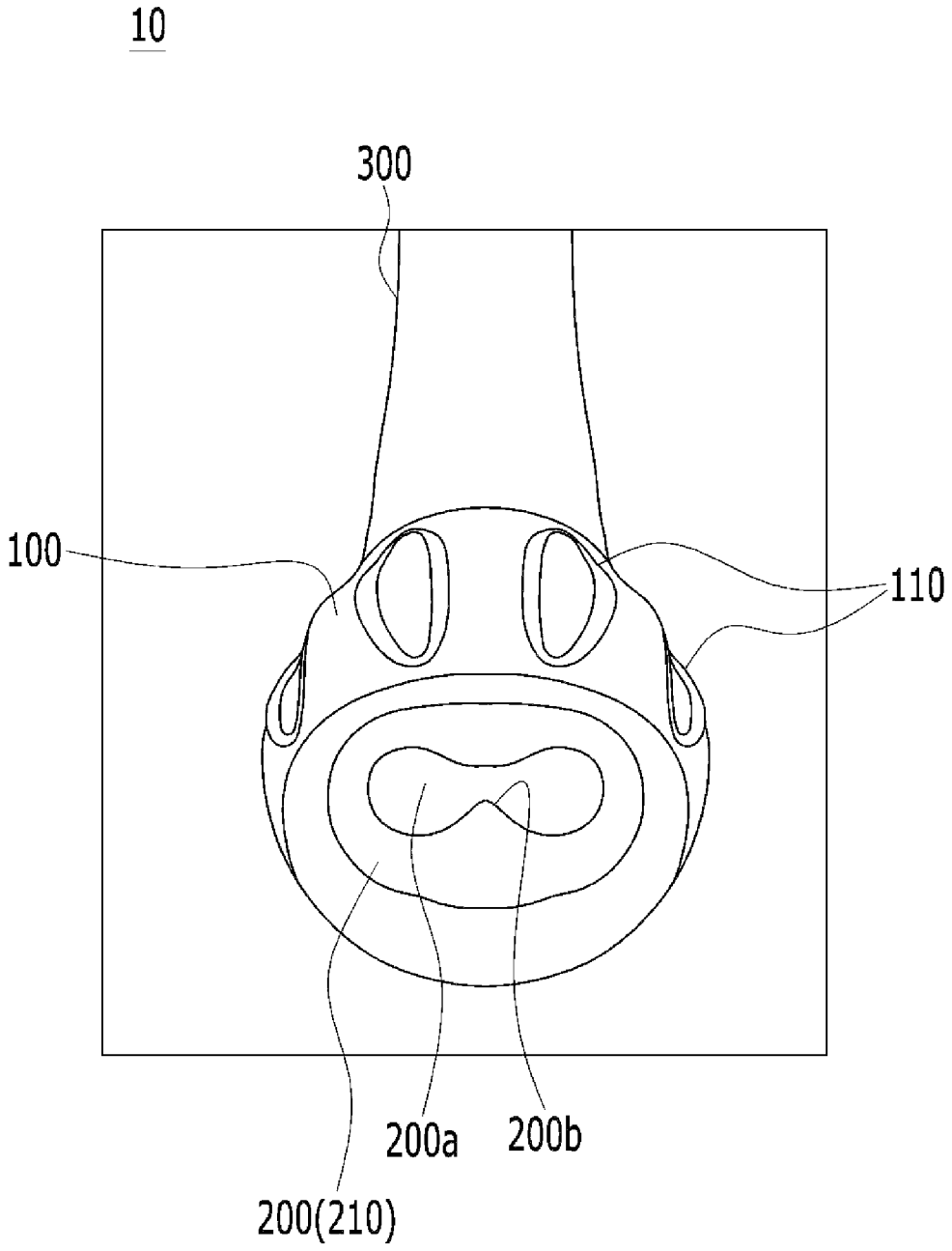
FIG. 2 is a configuration diagram illustrating a combined state of a receiving body and stopping holder of a pitching training aid according to an embodiment of the present invention.
Figure 3:
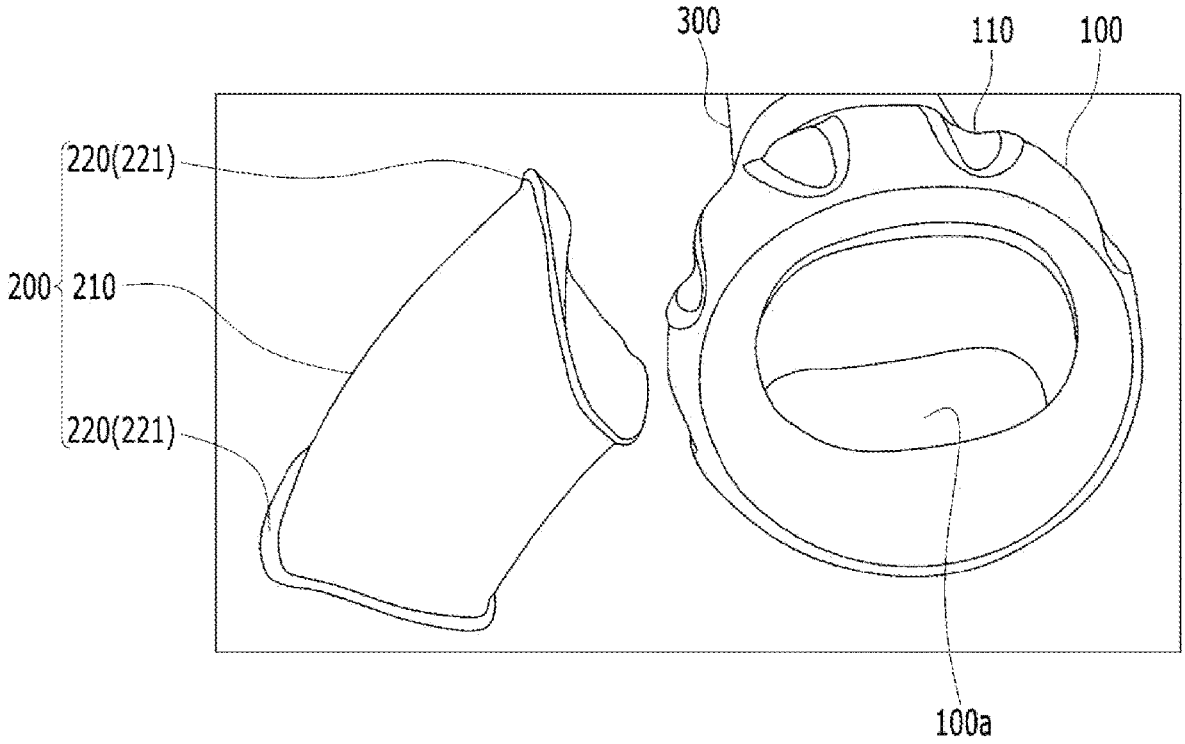
FIG. 3 is a configuration diagram illustrating a separated state of a receiving body and stopping holder of a pitching training aid according to an embodiment of the present invention.
Figure 4:
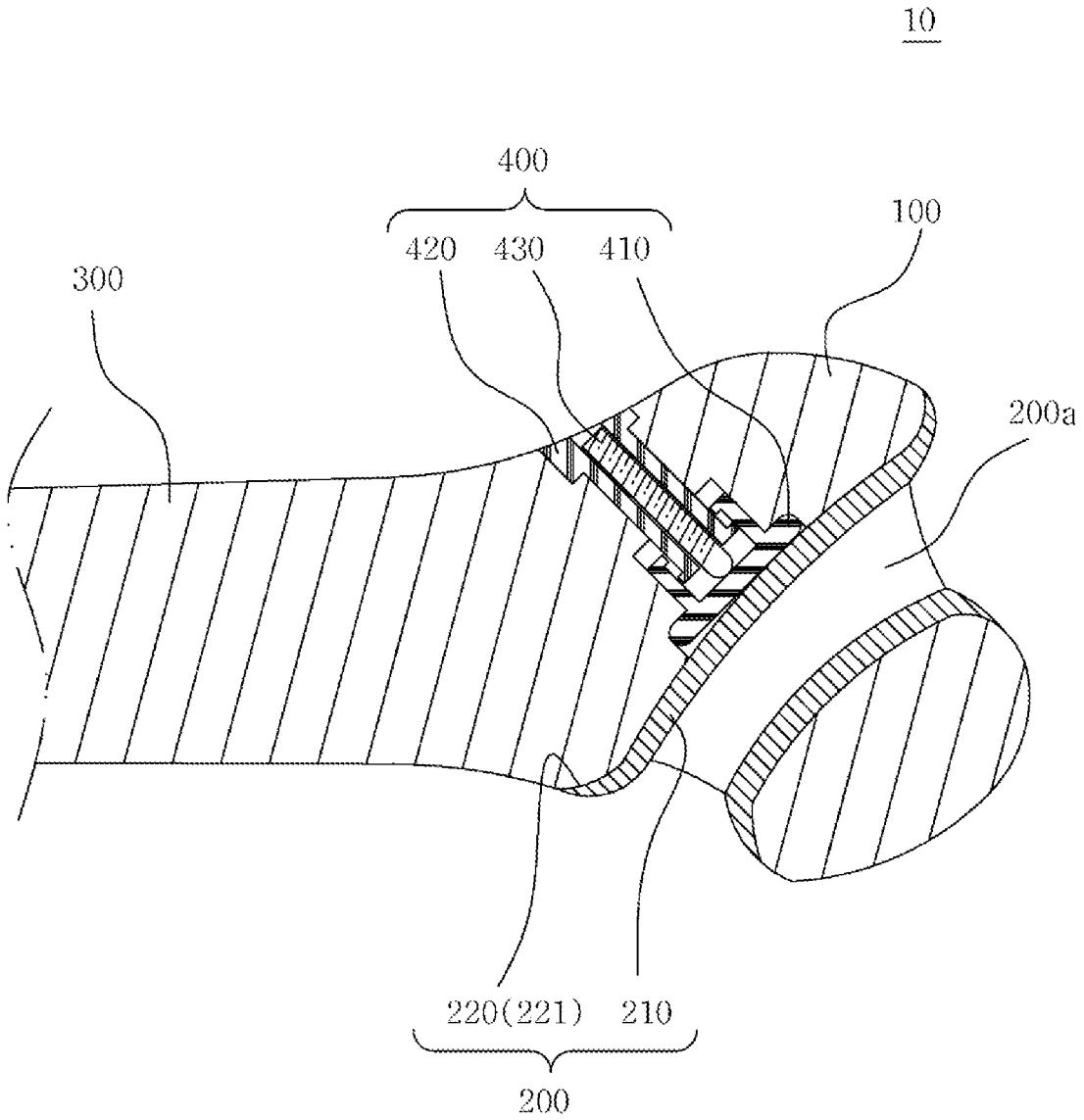
FIG. 4 is a longitudinal cross-sectional view illustrating a receiving body and stopping holder of a pitching training aid according to an embodiment of the present invention.
Figure 5:
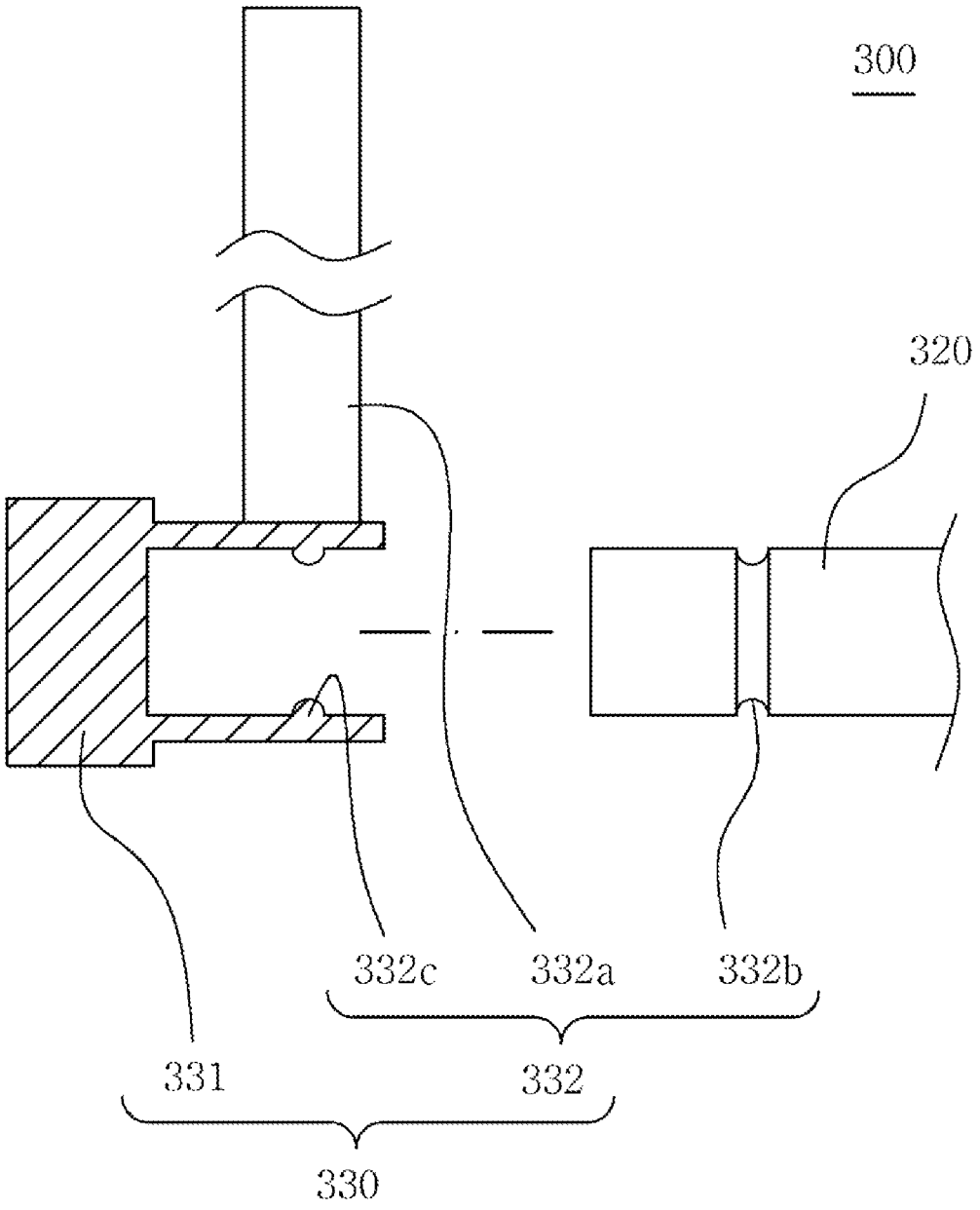
FIG. 5 is a configuration diagram illustrating an extension body of a pitching training aid according to an embodiment of the present invention.
Figure 6:
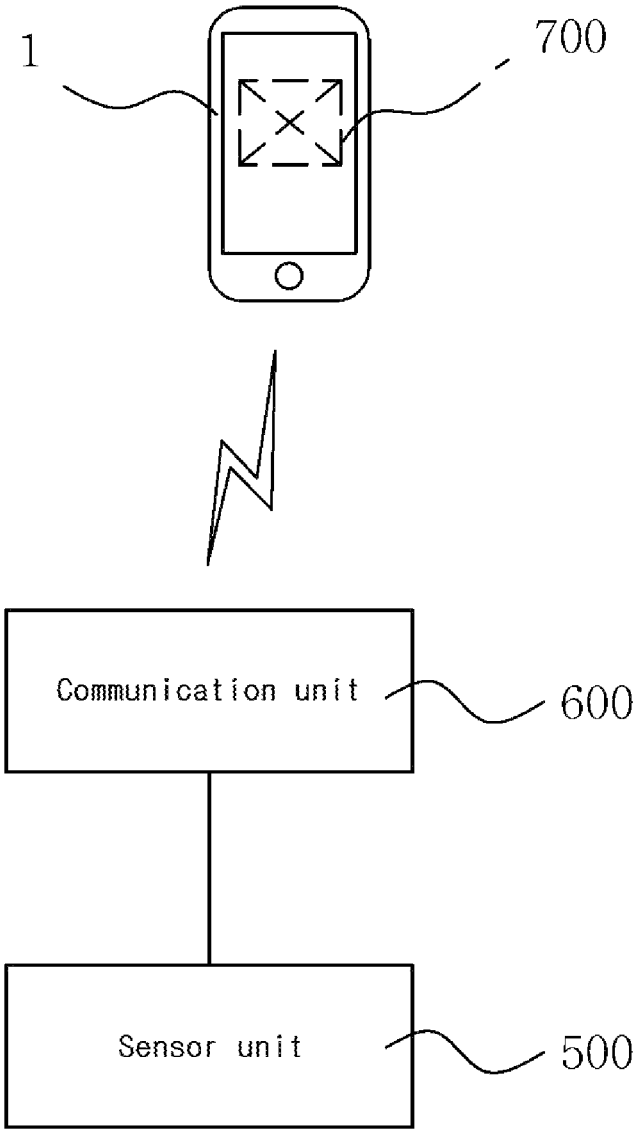
FIG. 6 is a block diagram illustrating a sensor unit and a communication unit of a pitching training aid according to an embodiment of the present invention.

FIG. 1 is a front view illustrating a pitching training aid according to an embodiment of the present invention. FIG. 2 is a configuration diagram illustrating a combined state of a receiving body and stopping holder of a pitching training aid according to an embodiment of the present invention. FIG. 3 is a configuration diagram illustrating a separated state of a receiving body and stopping holder of a pitching training aid according to an embodiment of the present invention. FIG. 4 is a longitudinal cross-sectional view illustrating a receiving body and stopping holder of a pitching training aid according to an embodiment of the present invention. FIG. 5 is a configuration diagram illustrating an extension body of a pitching training aid according to an embodiment of the present invention. FIG. 6 is a block diagram illustrating a sensor unit and a communication unit of a pitching training aid according to an embodiment of the present invention.

The pitching training aid 10 according to an embodiment of the present invention is a device that is gripped in a form wrapped in the user's hand or fitted with the user's fingers for shadow pitching training so as to provide the same weight and resistance as in actual pitching.

Specifically, the pitching training aid 10 according to an embodiment of the present invention may include a receiving body 100, a stopping holder 200 and an extension body 300 as illustrated in FIGS. 1 to 3.

The receiving body 100 is a component that forms the body of the pitching training aid 10, and is used while being gripped by the user's hand or fitted with the user's fingers via the stopping holder 200 to be described below. The receiving body 100 is a component for simulating a baseball.

Specifically, the receiving body 100 is formed substantially in a ball shape to be gripped in a form wrapped in the user's hand, and has openings in two sides and has a receiving space 100*a* to removably receive the stopping holder 200.

The receiving body 100 may be formed in a substantially cylindrical shape or may have a cylindrical shape with an elliptical outer appearance, or may be formed in a polygonal shape having an opening and a receiving space 100*a* therein.

The receiving body 100 may be formed of a synthetic resin material, such as EVA material. However, without being limited thereto, the receiving body 100 may be formed of wood or metal.

Further, the receiving body 100 may have a plurality of gripping recesses 110 in the outer circumferential surface, providing portions to be gripped in the user's hand.

As the plurality of gripping recesses 110 are formed in the outer circumferential surface of the receiving body 100, it is possible to simulate various grips of a baseball.

In addition to the gripping recesses 110, the receiving body 100 may also be formed with protruding rings (not shown) to simulate the seams formed on a baseball.

The stopping holder 200 is a component into which at least one finger of the user is fitted, and is a component that provides a portion to which the user's finger is stuck during shadow pitching training.

Specifically, the stopping holder 200 may be formed to be inserted into the receiving space 100*a* through the opening of the receiving body 100. The stopping holder 200 has a stopping hole 200*a* formed therethrough along the length direction thereof, providing the stopping hole 200*a* with a portion into which the user's finger is fitted for shadow pitching training.

In the stopping holder 200, as illustrated in FIG. 4, the stopping hole 200*a* extends in a curved shape having a predetermined curvature, thus stably seating the finger.

In other words, the stopping hole 200*a* may stably support the inserted finger by being formed in a curved shape corresponding to the direction in which the finger is curled.

This stopping holder 200 may include a holder body 210 and an anti-escape member 220.

The holder body 210 is a component constituting the body of the stopping holder 200, and may be formed in a cylindrical shape through which the stopping hole 200*a* is formed along the length direction thereof.

This holder body 210 may be formed of a foamed EVA material or a urethane material having a lower hardness than the above-described receiving body 100.

Accordingly, the holder body 210 is formed of a softer material than the receiving body 100 and has the physical properties of, e.g., sponge, so that the holder body 210 may be transformed to fit the finger sizes of various users.

The holder body 210 may have a dividing protrusion 200*b* formed in the stopping hole 200*a* as illustrated in FIG. 2.

The dividing protrusion 200*b* is a component that allows a plurality of fingers to be fitted into the stopping hole 200*a*, and is formed to protrude along the length direction of the stopping hole 200*a* to divide the stopping hole 200*a* into a plurality of holes, thereby allowing for insertion of, e.g., the user's index and middle fingers both.

The dividing protrusion 200*b* may function to divide the stopping hole 200*a* while simultaneously keeping the fingers apart, and may come in tight contact with the fingers while wrapping the fingers.

For shadow pitching training, the user passes the index and middle fingers through the stopping hole 200*a* of the holder body 210 and brings the index and middle fingers in tight contact with the curved surface of the stopping hole 200*a* and the dividing protrusion 200*b*, preventing the holder body 210 from escaping off the user's hand during swing.

Meanwhile, a holder body 210 may be manufactured for each user through a mold corresponding to the user's fingers, and may be selectively coupled to the receiving body 100 during shadow pitching training.

The stopping hole 200*a* of the holder body 210 may be firmly fitted to the finger by being formed to gradually decrease in size from the entrance end which the finger enters to the exit end which the finger exits.

Further, the stopping hole 200*a* of the holder body 210 has a pressurizing protrusion (not shown) that pressurizes the finger.

In other words, the pressurizing protrusion pressurizes the inner knuckle of the finger as does a ring, thereby achieving stability with no or little shaking even in the accelerated movement of the arm during shadow pitching and preventing the holder body 210 from escaping off the finger by being stuck to the finger joint during the finishing motion of the shadow pitching when the arm swing is decelerated.

Further, the pressurizing protrusion may be formed in the shape of a ring on the outside of the receiving body and may be completely fitted up to the base of the finger, further preventing the holder body from escaping off the finger.

Meanwhile, the holder body 210 may have a joint seating groove formed in the inner circumferential surface thereof to allow the finger joint to rest and be stuck thereto, instead of the pressurizing protrusion.

Further, the receiving body 210 may also be formed with protruding rings (not shown) to simulate the seams formed on a baseball.

The anti-escape member 220 is a component for preventing the holder body 210 inserted into the receiving space 100*a* of the receiving body 100 from arbitrarily escaping from the receiving body 100.

For example, the anti-escape member 230 may include a pair of anti-escape protrusion 221 as illustrated in FIGS. 3 and 4.

The anti-escape protrusion 221 may be protrusion formed along the periphery at two opposite ends, in the length direction, of the holder body 210, and may be stuck and fastened to two opposite ends of the receiving space 100*a* of the receiving body 100.

Accordingly, the holder body 210 may be stuck to two opposite ends of the receiving space 100*a* by the anti-escape protrusion 221 221 and may thus be firmly fastened while being prevented from moving in the length direction of the receiving space 100*a*.

Moreover, the receiving space 100*a* of the receiving body 100 and the holder body 210 are formed in an arc shape as illustrated in FIG. 4 and face each other through their arc-shaped curved surfaces and, as the holder body 210 is suppressed from linear movement of the holder body 210, they may be prevented from being arbitrarily separated from each other.

The anti-escape protrusion 221 may be formed in a curved shape to be in tight contact with the finger.

Meanwhile, instead of the above configuration, the anti-escape member 220 may be configured with an anti-escape protrusion and an anti-escape groove, which have a male structure and a female structure, which may be engaged with each other, and are formed in the holder body 210 and the receiving body 100, respectively.

The holder body 210 is formed with a larger outer diameter than the receiving space 100*a* of the receiving body 100 and may be press-fitted into the receiving body 100 and prevented from arbitrarily escaping off the receiving body 100.

The extension body 300 may be shaped as a rod and extend by a predetermined length from one side of the receiving body 100. The extension body 300 may be a component that provides a load or vibration through a reaction to rotation or bending of the arm during shadow pitching training.

In other words, the extension body 300 may be elastically deformed by the rotation or bending of the arm and restored, thereby providing a load or vibration and hence providing such a feel of weight as if an actual baseball is thrown.

Specifically, the extension body 300 may include a post part 310 and an elastic shaft 320 as illustrated in FIG. 1.

The post part 310 may integrally protrude from one side of the receiving body 100, providing support.

This post part 310 may provide an installation portion for a sensor unit 500 to be described below.

The elastic shaft 320 may extend lengthwise from the post part 310 in the opposite direction of the receiving body 100.

The post part 310 and the elastic shaft 320 may be formed of the same material as the receiving body 100 and extend in a rod shape, and their outer circumstantial surface may be coated with a coating material, such as silicone.

Further, the elastic shaft 320 may have a mandrel (not shown) built in along the length direction to provide an elastic force through the mandrel.

The elastic shaft 320 may form the same body as the receiving body 100 while being fixed to the post part 310 through screw coupling, or the elastic shaft 320 may form the same body as the receiving body 100 by being fixed via an angle adjustment hinge (not shown) to be angle-adjusted in an upper, lower, left, or right direction.

In this case, there may be provided a plurality of elastic shafts 320 with different lengths so that one with a length suitable for the user may be selected.

Further, as illustrated in FIG. 1, the elastic shaft 320 may extend in the opposite direction of the post part 310 while being inclined in an upper direction of the receiving body 100 as it goes away from the receiving body 100.

Further, the elastic shaft 320 may extend along a straight line in the opposite direction of the post part 310 while thinning as it goes away from the receiving body 100.

Alternatively, the elastic shaft 320 may extend in a multi-step structure, not a straight line, in the opposite direction of the post part 310, so that the multi-stage structure has steps whose thickness decreases as it goes away from the receiving body 100.

Meanwhile, the pitching training aid 10 according to an embodiment may further include a weight 330 as illustrated in FIG. 5.

The weight 330 is an optional component that is removably coupled to an end of the elastic shaft 320 to provide additional weight.

The weight 330 may include a weight cap 331 and a cap fastening member 332 as illustrated in FIG. 5.

The weight cap 331 is a component that is fitted and fixed to the end of the elastic shaft 320 to provide weight or may be removed from the end of the elastic shaft 320.

This weight cap 331 is formed in a cap shape and may be fitted and fixed to the end of the elastic shaft 320. The weight cap 331 may have a built-in metal body to provide weight to the end of the elastic shaft 320, and the weight cap 331 may increase the length of the elastic shaft 320 and the air resistance.

The weight cap 331 may be formed in a spherical or hemispherical shape.

The cap fastening member 332 is a component for fixing the above-described weight cap 331 to the end of the elastic shaft 320.

As illustrated in FIG. 5, the cap fastening member 332 may be formed of a hook-and-loop fastener 332*a* to wrap around the weight cap 331 together with the elastic shaft 320 to fasten them.

One end of the hook-and-loop fastener 332*a* may be fastened to the weight cap 331 to form a fixed end, and the opposite free end thereof may wrap around and fasten the weight cap 331 together with the elastic shaft 320.

The hook-and-loop fastener 332*a* may be configured separately from the weight cap 331.

The cap fastening member 332 may have any configuration, e.g., screw coupling, which may fasten the weight cap 331 to the elastic shaft 320.

The cap fastening member 332 may further include a cap stopping groove 332*b* and a cap stopping jaw 332*c* as illustrated in FIG. 5.

The cap stopping groove 332*b* may be grooved circumferentially in the outer circumstantial surface of the end of the elastic shaft, providing a stopping portion for the weight cap 331.

The cap stopping jaw 332*c* may protrude circumferentially on the inner circumferential surface of the weight cap 331 and may be stuck and fastened to the cap stopping groove 332*b*.

In other words, the weight cap 331 may be press-fittingly fastened to the end of the elastic shaft 320 through the configuration of the cap stopping groove 332*b* and the cap stopping jaw 332*c*, and in the fastened state, may be further securely fastened by the hook-and-loop fastener 332*a*.

Meanwhile, the pitching training aid 10 according to an embodiment may further include a holder pressurizing member 400 as illustrated in FIG. 4.

The holder pressurizing member 400 is a component that may artificially pressurize the above-described stopping holder 210 to adjust the size of the stopping hole 200*a*.

In other words, the holder pressurizing member 400 is a component that firmly fits the stopping holder 210 to the user's finger by adjusting the size of the stopping hole 200*a* to fit the user's finger.

Specifically, the holder pressurizing member 400 may include a pressurizing plate 410, a bolt guide 420, and a pressurizing bolt 430.

The pressurizing plate 410 is a component that is moved by external force to directly pressurize the stopping holder 210 to thereby adjust the size of the stopping hole 200*a*.

This pressurizing plate 410 is movably coupled to the receiving body 100 as illustrated in FIG. 4 to face the stopping holder 210. The pressurizing plate 410 is pressurized via the pressurizing bolt 430 by the user's external force and is thus moved toward the stopping holder 210 to adjust the size of the stopping hole 200*a*.

The pressurizing plate 410 may be shaped substantially as a cap and may be formed so that a surface thereof, contacting the stopping holder 210, is expanded. The moving distance, along the bolt guide 420, of the pressurizing plate 410 may be limited.

The bolt guide 420 is a component that guides the movement of the above-described pressurizing plate 410 and provides a screw coupling portion of the pressurizing bolt 430.

Specifically, the bolt guide 420 may be adjacently coupled to the pressurizing plate 410 and fastened to the receiving body 100, guiding the lengthwise movement of the pressurizing plate 410. The bolt guide 420 may be coupled with the pressurizing plate 410 to be stuck to a stopping jaw, thus limiting the moving distance of the pressurizing plate 410.

The bolt guide 420 may provide a coupling portion of the pressurizing bolt 430 by having a female screw along the length direction.

The pressurizing bolt 430 is a component that moves the pressurizing plate 410, and is screwed to the bolt guide 420. The pressurizing bolt 430 may be rotated by the user to protrude toward the pressurizing plate 410, thereby moving the pressurizing plate 410 and hence pressurizing the holder body 210.

In other words, in the case of shrinking the stopping hole 200*a* of the holder body 210, the pressurizing bolt 430 may be rotated by the user, protruding toward the pressurizing plate 410 and thus moving the pressurizing plate 410 to shrink the stopping hole 200*a*.

The pitching training aid 10 according to an embodiment may further include a sensor unit 500 and a communication unit 600 as illustrated in FIG. 6.

The sensor unit 500 is a component that detects and provides at least one of the acceleration, angular velocity, and orientation of the extension body 300 during the users pitching practice, so that data for the pitching practice may be obtained through the sensed data.

In other words, the sensor unit 500 may transmit and record information for each pitching motion, including the arm swing trajectory, to a smartphone for more intelligent training, and allows the user to visualize the information in 3D to make immediate comparison and determination.

The sensor unit 500 may be embedded in the post part 310 constituting the extension body 300.

The communication unit 600 is a component that applies the detection signal obtained by the sensor unit 500 to an application 700 installed on the user's terminal 1.

The communication unit 600, together with the sensor unit 500, may be embedded in the receiving body 100 or in the extension body 300.

Alternatively, the sensor unit 500 and the communication unit 600 may be embedded in the above-described weight 330 and, thus, may be, along with the weight 330, fastened to the elastic shaft 320 constituting the extension body 300.

The communication unit 600 may be any one of a Bluetooth module, a Wi-Fi module, and a wireless communication module and may wirelessly communicate with the application 700 of the terminal 1.

Specifically, the Bluetooth module means a module that communicates with the terminal in a short-range wireless communication scheme. The Wi-Fi module means a module that performs communication in a Wi-Fi scheme. The wireless communication module means a module that performs communication according to various communication standards, such as IEEE, Zigbee, 3rd generation (3G), 3rd generation partnership project (3GPP), long term evolution (LTE), LTE-A, 4G, or 5G. Zigbee is the standard technology for configuring, and performing communicating with, a personal communication network using a small, low-power digital radio, and may mean the one that is created based on the IEEE 802.15 standard.

The application 700 may be installed on the terminal 1 such as a smartphone, tablet computer, or server, and may obtain at least one of the pitching posture of the arm swing, the speed of the ball, and the rotation axis of the ball, based on state information for the extension body 300 by the detection signal applied from the sensor unit 500 and output and store to the terminal 1.

Further, the application 700 may calculate the maximum internal rotational speed of the arm, the angle of the arm at the time of release, and the expected ball speed through the detection signal from the sensor unit 500 and provide them as visual data.

Therefore, the user may visually identify the pitching posture or the practice result based on the data applied to the application 700 of the terminal 1.

As described above, in the pitching training aid 10 according to an embodiment, the extension body 300 provides a load while being elastically deformed and restored, so that it is possible to provide a feel of throwing an actual ball. In particular, the stopping holder 210 fitted over the user's finger may be firmly fastened to the receiving body by the anti-escape member 220. Further, the size of the stopping hole 200*a* of the stopping holder 210 may be adjusted through the holder pressurizing member 400. Therefore, the stopping holder 210 may be securely fitted to the user's finger, and may be prevented from arbitrarily escaping off during training.

Although embodiments of the present invention have been described with reference to the accompanying drawings, it will be appreciated by one of ordinary skill in the art that the present disclosure may be implemented in other various specific forms without changing the essence or technical spirit of the present disclosure. Thus, it should be noted that the above-described embodiments are provided as examples and should not be interpreted as limiting. Each of the components may be separated into two or more units or modules to perform its function(s) or operation(s), and two or more of the components may be integrated into a single unit or module to perform their functions or operations.

It should be noted that the scope of the present invention is defined by the appended claims rather than the described description of the embodiments and include all modifications or changes made to the claims or equivalents of the claims.

LEGEND OF REFERENCE NUMBERS

10: pitching training aid 100: receiving body
110: gripping recess 100*a*: receiving space
200: stopping holder 200*a*: stopping hole
200*b*: dividing protrusion 210: holder body
220: anti-escape member 221: anti-escape protrusion
300: extension body 310: post part
320: elastic shaft 330: weight
331: weight cap 332: cap fastening member
332*a*: hook-and-loop fastener 332*b*: cap stopping groove
332*c*: cap stopping jaw 400: holder pressurizing member
410: pressurizing plate 420: bolt guide
430: pressure bolt 500: sensor unit
600: communication unit 700: application
1: terminal

The invention claimed is:

1. A pitching training aid for shadow pitching training, comprising: a receiving body having openings in two sides thereof, including a receiving space to simulate a baseball;

a stopping holder removably inserted into the receiving space through the openings of the receiving body, having a stopping hole formed therethrough along a lengthwise direction thereof to provide a stopping portion, the stopping hole extending in a curved shape with a predetermined curvature; and an extension body extending from one end of the receiving body in a rod shape having a predetermined length.

2. The pitching training aid of claim 1, wherein the stopping holder includes a holder body formed in a tubular shape having the stopping hole formed therethrough and fastened to the receiving space of the receiving body and an anti-escape member preventing the holder body from escaping off the receiving body.

3. The pitching training aid of claim 2, wherein the holder body includes a dividing protrusion that protrudes along a lengthwise direction of the stopping hole and divides the stopping hole.

4. The pitching training aid of claim 2, wherein the stopping hole decreases in size from an entrance end to an exit end.

5. The pitching training aid of claim 2, wherein the anti-escape member includes an anti-escape protrusion at each of two opposite ends, in a length direction, of the holder body, the anti-escape protrusion secured to an end of the receiving space of the receiving body to prevent the holder body from moving in a lengthwise direction of the receiving space of the receiving body.

6. The pitching training aid of claim 1, wherein the receiving body has a plurality of gripping recesses formed in an outer circumferential surface thereof to provide a gripping portion.

7. The pitching training aid of claim 1, wherein the extension body includes a post part formed on one end of the receiving body to provide support and an elastic shaft extending, in a rod shape, from the post part.

8. The pitching training aid of claim 7, wherein the elastic shaft thins as the elastic shaft extends, in a straight line, away from the post part.

9. The pitching training aid of claim 7, wherein the extension body further includes a weight removably coupled to an end of the elastic shaft to provide weight.

10. The pitching training aid of claim 9, wherein the weight includes a weight cap fitted and fastened to the end of the elastic shaft and having a built-in metallic weight body, and a cap fastening member fastening the weight cap to the end of the elastic shaft.

11. The pitching training aid of claim 10, wherein the cap fastening member includes a hook-and-loop fastener fixed in a form of wrapping around the weight cap.

12. The pitching training aid of claim 10, wherein the cap fastening member further includes a cap stopping groove circumferentially formed, in a groove shape, in an outer circumferential surface of the elastic shaft and a cap stopping jaw circumferentially protruding from an inner circumferential surface of the weight cap and secured in the cap stopping groove.

13. The pitching training aid of claim 1, further comprising a holder pressurizing member installed in the receiving body to adjust a size of the stopping hole while pressurizing the stopping holder.

14. The pitching training aid of claim 13, wherein the holder pressurizing member includes a pressurizing plate partially facing the stopping holder in a state movably coupled to the receiving body, and pressed by external force to move toward the stopping holder to reduce the size of the stopping hole, a bolt guide fastened to the receiving body while contacting the pressurizing plate to provide a screw coupling portion, and a pressurizing bolt screwed to the bolt guide and protruded toward the pressurizing plate by rotation to move the pressurizing plate.

15. The pitching training aid of claim 1, further comprising a sensor unit embedded in the receiving body or the extension body to detect at least one selected from the group consisting of an acceleration, angular velocity, and orientation of the rotation of a user's arm and a communication unit applying a detection signal obtained by the sensor unit to an application installed on the user's terminal.

16. The pitching training aid of claim 15, wherein the application calculates at least one selected from the group consisting of a pitching posture, ball speed, and ball rotation axis based on the detection signal applied from the sensor unit and output and store to the terminal.

* * * * *